US005839168A

United States Patent [19]

Elkins

[11] Patent Number: 5,839,168

[45] Date of Patent: Nov. 24, 1998

[54] CLIP FOR HOLDING WRITING INSTRUMENTS

[75] Inventor: Robert W. Elkins, Oak Ridge, N.C.

[73] Assignee: Grand Ideas, Inc., Greensboro, N.C.

[21] Appl. No.: 888,635

[22] Filed: Jul. 7, 1997

[51] Int. Cl.[6] ..... A45F 5/00; B43K 25/00

[52] U.S. Cl. ..... 24/11 S; 24/11 R; 24/11 CT; 24/11 PP

[58] Field of Search ..... 24/11 S, 11 R, 24/11 PP, 11 HC, 11 P, 11 CT, 10 R, 3.11

[56] References Cited

U.S. PATENT DOCUMENTS

| | | | |
|---|---|---|---|
| 637,889 | 11/1899 | Parker | 24/11 PP |
| 1,484,321 | 2/1924 | Brouillette et al. | 24/11 CT |
| 2,802,250 | 8/1957 | Klotz | 24/11 PP |
| 3,983,602 | 10/1976 | Barry | 24/11 R |
| 4,157,152 | 6/1979 | Blastic | 24/11 PP |
| 5,016,559 | 5/1991 | Larson et al. . | |
| 5,129,126 | 7/1992 | Huang | 24/3.11 |
| 5,184,375 | 2/1993 | Hoyt | 24/11 PP |
| 5,718,023 | 2/1998 | Billish | 24/11 HC |

OTHER PUBLICATIONS

Drawings from co–pending design application 29/063,932 filed 19 Dec. 1996.

*Primary Examiner*—Victor N. Sakran

[57] ABSTRACT

A clip for holding a writing instrument such as a ballpoint or felt tipped pen is provided which is also useful as a book mark, for example in a text book. The device is formed from an inexpensive, suitable plastic and allows the user to withdraw the pen shaft for writing while the pen cap is retained by the clip. Depending legs pivot to accept book pages for maintaining the clip in frictional engagement thereon.

14 Claims, 4 Drawing Sheets

CLIP FOR HOLDING WRITING INSTRUMENTS

BACKGROUND OF THE INVENTION

1. Field of the Invention

The invention herein pertains to devices for holding writing instruments such as pens or felt markers and particularly to a device which can be positioned on a book for holding a variety of writing instruments proximate thereto.

2. Description of the Prior Art and Objectives of the Invention

Various devices have been used in the past to hold pencils, pens, felt markers and the like and other such items as set forth in U.S. Pat. No. 5,016,559 in or on books. Also, many forms of book marks have been used in the past to maintain a reader's place, should the reader be interrupted. Conventional book marks often slip out of the pages of the book and defeat the purpose for which they are intended.

Thus, with the disadvantages and problems associated with prior art pen holders and book marks, the present invention was conceived and one of its objectives is to provide a simple, inexpensive clip for holding a writing instrument which can be releasably positioned on a book back, book front, or on pages of the book as needed.

It is a further objective of the present invention to provide a clip for holding a writing instrument which will frictionally engage a surface such as a page of a book to "mark" the page while conveniently holding a pen or other writing instrument.

It is yet a further objective of the present invention to provide a clip which will easily allow inserting or removing a writing instrument with one hand.

It is also an objective of the present invention to provide a clip molded from plastic which includes a pair of depending legs for securely gripping book pages therebetween.

It is still another objective of the present invention to provide a clip for holding a writing instrument which contains a slot for selective securement of a pen retainer for convenient removal of the pen shaft.

Various other objectives and advantages of the present invention will become apparent to those skilled in the art as a more detailed description is set forth below.

SUMMARY OF THE INVENTION

The aforesaid said other objectives and advantages of the present invention are realized by providing a clip for holding writing instruments such as felt tipped pens or other writing instruments contiguous to a book or other text materials. The clip is molded from a suitable plastic such as polyethylene and includes a horizontal C-shaped writing instrument holder with a slot for engaging a pen retainer from which two depending, non-parallel legs extend. The non-parallel legs are pivotal relative to each other for gripping and securing book pages therebetween. The edges of the depending legs are beveled for convenience in sliding between pages of a book when placing the clip thereon. The C-shaped instrument holder is sized to firmly grasp a pen cap while the slot receives the pen retainer to allow the user to extract the writing shaft of the pen while the cap remains within the clip.

DETAILED DESCRIPTION OF THE PREFERRED EMBODIMENT AND OPERATION OF THE INVENTION

Figure 2:
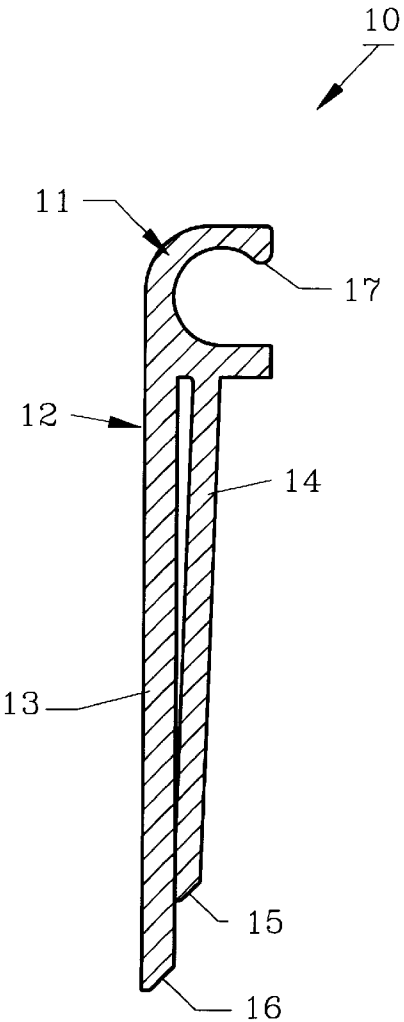
FIG. 2 depicts a cross-sectional view of the clip as shown in FIG. 1 along lines 2—2.
Figure 1:
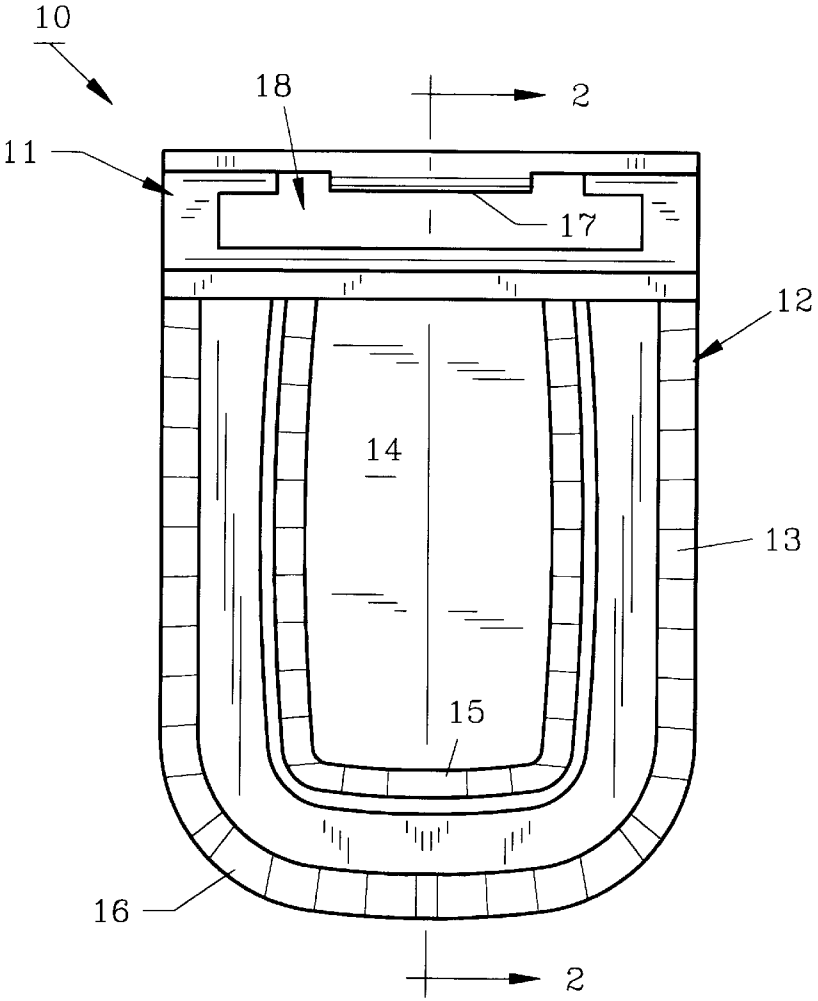
FIG. 1 shows a front view of the preferred form of the invention without a writing instrument.

For a better understanding of the invention and its use, turning now to the drawings, FIG. 1 demonstrates a front view of clip 10 which illustrates the preferred embodiment. As seen, clip 10 provides an upper writing instrument holder 11 having a C-shaped cross section (FIG. 2) and depending retaining means 12 to releasably retain clip 10 to a book or the like. Holder 11 defines slot 18 with a shorter upper length and a longer lower length. As shown, retaining means 12 includes a rear leg 13 and a shorter front leg 14 as shown in FIG. 2. Rear leg 13 is longer and is U-shaped. Front leg 14 is shorter and is substantially planar with beveled edge 15. Rear leg 13 also includes beveled edge 16 along its distal end around its U-shaped periphery. Beveled edges 15 and 16 allow clip 10 to easily slide between book pages by separating them.

In FIG. 2 the non-parallel posture of legs 13 and 14 is shown which allows legs 13, 14 when opened, to easily grip the back of a book or book pages tightly therebetween. Front leg 14 is manually pivotable as clip 10 is integrally molded from a suitable plastic such as polyethylene or other durable polymeric materials. Clip latch 17 is interior of instrument holder 11 and is used to maintain pen 20 (as shown in FIG. 3) within instrument holder 11 with pen retainer 23 engaged within slot 18.

Figure 3:
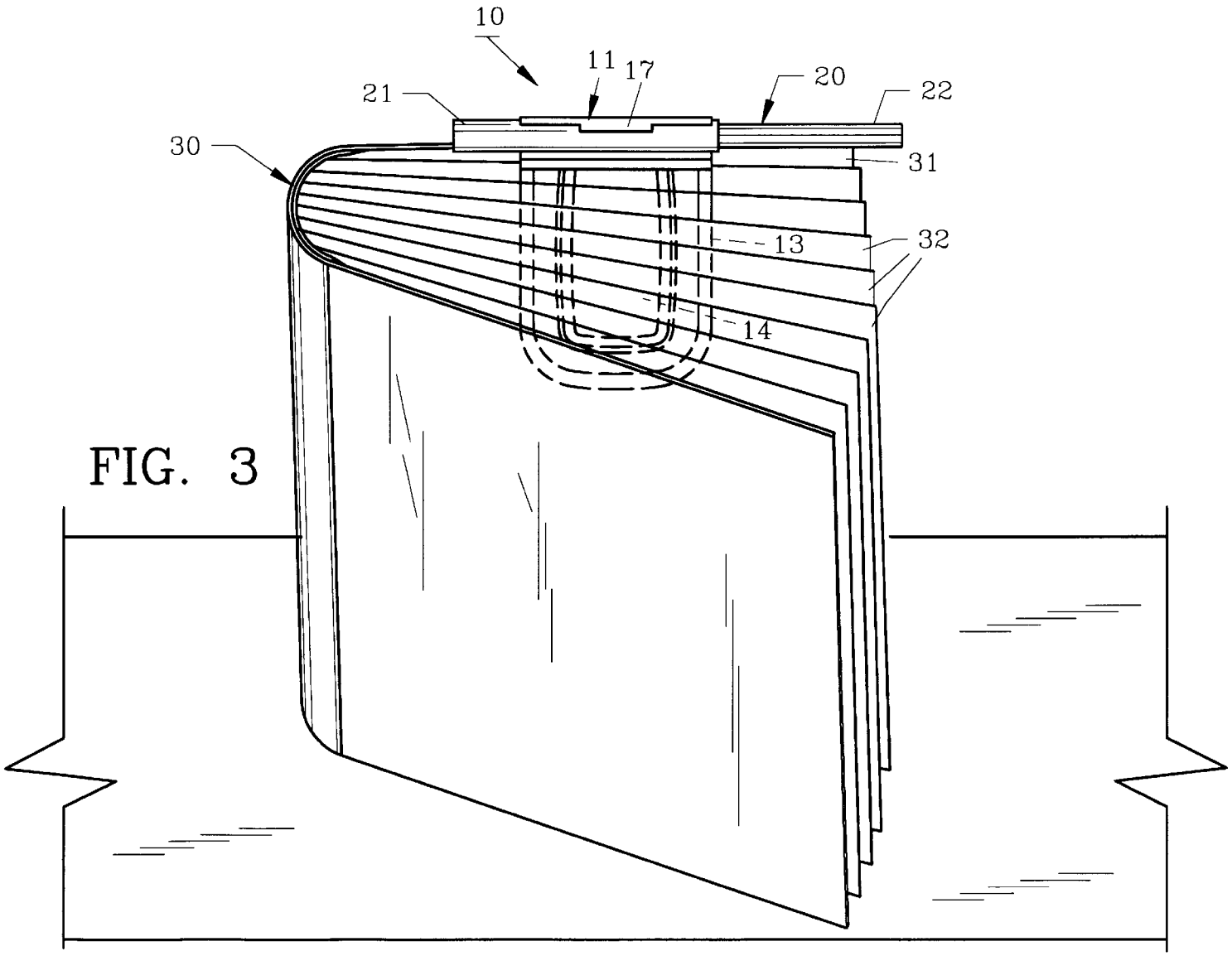
FIG. 3 features a front view of the clip as shown in FIGS. 1 and 2 attached to the back of book while holding a writing instrument therein. demonstrates a rear view of the invention of FIG. 1 showing a pen retainer in the longer, lower axial length of the slot of the writing instrument holder.

In FIG. 3 clip 10 is seen positioned on book 30. Clip 10 can be used as a page marker for example by gripping certain pages 32 of book 30 between legs 13 and 14 as needed. Book back 31 is retained between front leg 14 and rear leg 13 to maintain clip 10 thereon in FIG. 3 while instrument holder 11 tightly grasps cap 21 of pen 20.

Figure 4:
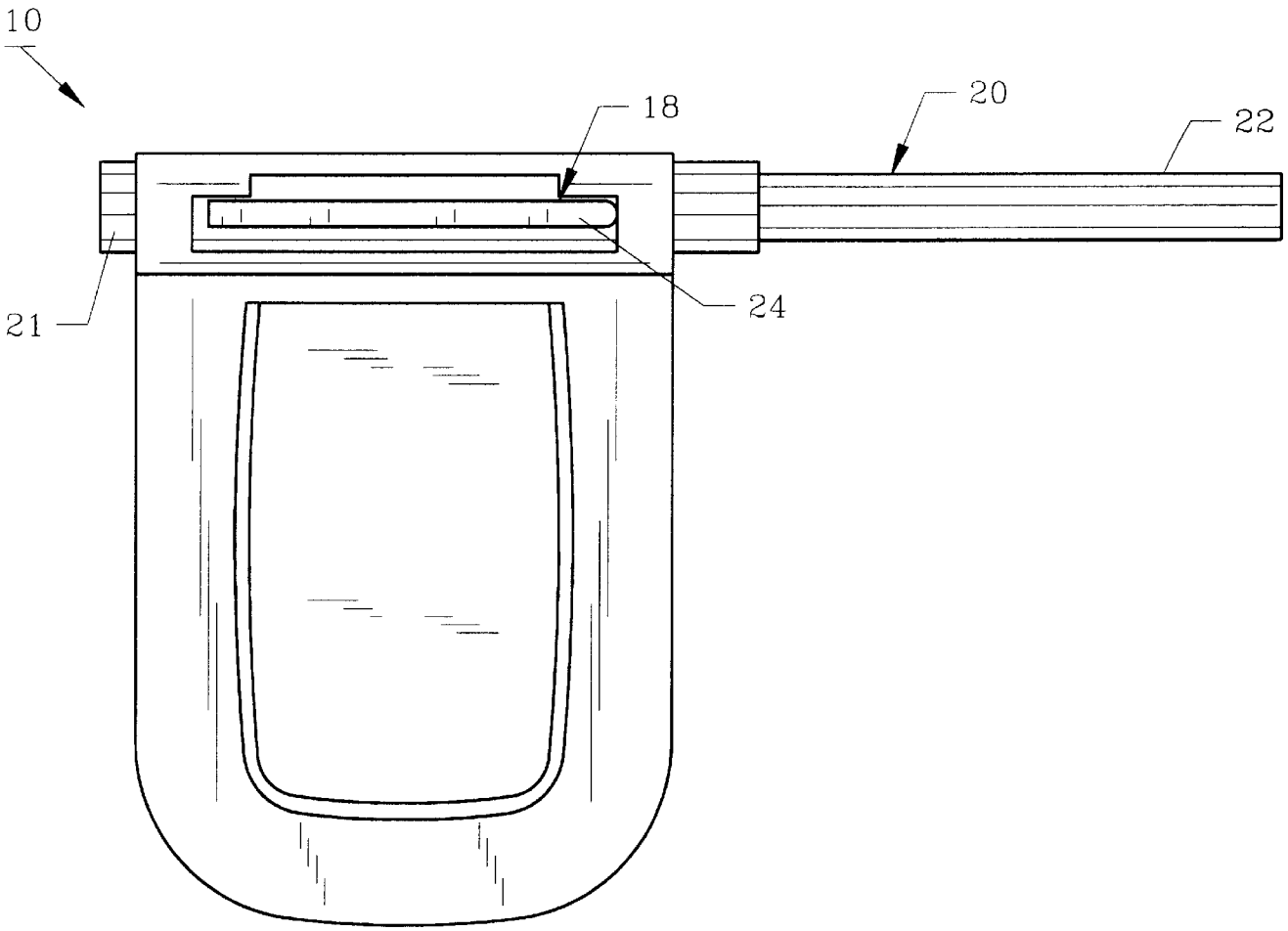
Figure 5:
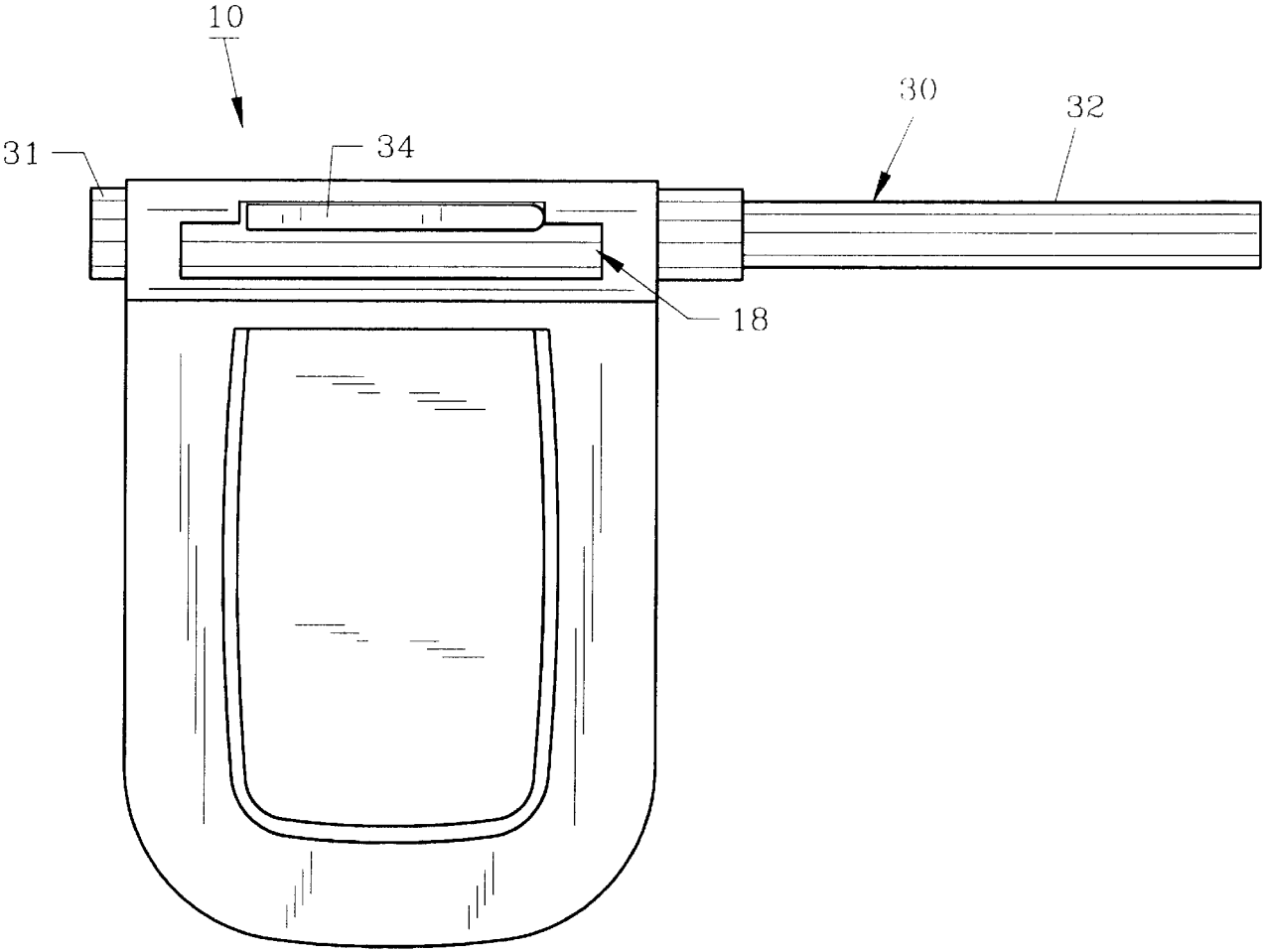
FIG. 5 provides a rear view as in FIG. 4 but with a pen retainer in the shorter upper axial length of the slot.

In FIG. 4 pen retainer 24 is positioned in slot 18, along the longer lower axial length. Pen 30 as seen in FIG. 5 has shorter pen retainer 34 which is held by slot 18 in the shorter upper axial length. Thus, when pen shafts 22, 32 are removed from respectively, pens 20, 30 pen caps 21, 31 with pen retainers 24, 34 remain within clips 10 as seen in FIGS. 4 and 5. Pen shafts 22, 32 can easily be returned to pen caps 21, 31 after use until needed again.

Clip 10 as the preferred embodiment is molded from a lightweight, durable plastic although other embodiments and uses may determine that metal or other materials be used in the fabrication process.

The illustrations and examples provided herein are for explanatory purposes and are not intended to limit the scope of the appended claims.

I claim:

1. A clip for a writing instrument comprising: means to releasably retain said clip on a planar surface, and a writing instrument holder, said instrument holder attached to said retaining means, said writing instrument holder defining a slot, said slot including a shorter upper length and a longer lower length.

2. The clip of claim 1 wherein said retaining means comprises a pair of depending legs.

3. The clip of claim 2 wherein said legs are non-parallel.

4. The clip of claim 2 wherein one of said legs is U-shaped.

5. The clip of claim 2 wherein one of said legs is pivotable.

6. The clip of claim 1 wherein said retaining means is integrally molded with said writing instrument holder.

7. The clip of claim 1 further comprises a latch, said latch affixed to said instrument holder.

8. The clip of claim 1 wherein said retaining means comprises a pair of depending, non-parallel legs, wherein said retaining means is integrally molded with said writing instrument holder, wherein one of said legs is U-shaped, wherein one of said legs is pivotable, wherein said clip is molded from plastic, and further comprising a latch, said latch affixed to said instrument holder.

9. A clip for conveniently holding a writing instrument on a book comprising: a writing instrument holder, said instrument holder comprising a C-shaped cross section, a latch, said latch attached interiorly of said instrument holder, means to retain said clip on said book, said retaining means comprising a pair of non-parallel legs, said legs depending from said instrument holder, one of said legs having a U-shape and extending beyond the other of said legs, said writing instrument holder defining a T-shaped slot.

10. The clip of claim 9 molded from a plastic.

11. The clip of claim 9 wherein said legs pivot relative to each other.

12. The clip of claim 9 wherein said U-shaped leg comprises a beveled edge.

13. The clip of claim 9 wherein the distal end of said U-shaped leg comprises a beveled edge.

14. The clip of claim 9 wherein said clip is molded from plastic, wherein said legs pivot relative to each other, wherein the distal end of said U-shaped leg comprises a beveled edge.

* * * * *